US012108838B2

(12) United States Patent
Frada

(10) Patent No.: US 12,108,838 B2
(45) Date of Patent: Oct. 8, 2024

(54) CONNECTING DEVICE BETWEEN A LOWER SHELL AND A CUFF OF A SKI BOOT

(71) Applicant: ROSSIGNOL LANGE S.R.L., Montebelluna Treviso (IT)

(72) Inventor: Danilo Frada, Montebelluna Treviso (IT)

(73) Assignee: ROSSIGNOL LANGE S.R.L., Treviso (IT)

( * ) Notice: Subject to any disclaimer, the term of this patent is extended or adjusted under 35 U.S.C. 154(b) by 46 days.

(21) Appl. No.: 18/078,644

(22) Filed: Dec. 9, 2022

(65) Prior Publication Data

US 2023/0180882 A1 Jun. 15, 2023

(30) Foreign Application Priority Data

Dec. 10, 2021 (EP) ..... 21425063

(51) Int. Cl.
*A43B 5/04* (2006.01)

(52) U.S. Cl.
CPC ..... *A43B 5/0427* (2013.01)

(58) Field of Classification Search
CPC ... A43B 5/0462; A43B 5/0464; A43B 5/0468; A43B 5/047; A43B 5/0472; A43B 5/0474; A43B 5/0427
See application file for complete search history.

(56) References Cited

U.S. PATENT DOCUMENTS 3,698,106 A * 10/1972 Rieker ..... A43B 5/0452 36/118.8
5,740,620 A * 4/1998 Giese ..... A43B 5/046 36/118.2
2017/0280818 A1* 10/2017 Mandon ..... A43B 5/0405

FOREIGN PATENT DOCUMENTS

EP 2 620 068 A1 7/2013
EP 3 228 202 A1 10/2017
FR 2847173 A1 * 5/2004 ..... A43B 5/0452
FR 2985889 A1 * 7/2013 ..... A43B 5/0427

OTHER PUBLICATIONS

Written Opinion dated May 30, 2022, issued in counterpart EP application No. 21425063.1. (6 pages).

* cited by examiner

*Primary Examiner* — Heather Mangine
*Assistant Examiner* — Erick I Lopez
(74) *Attorney, Agent, or Firm* — WHDA, LLP

(57) ABSTRACT

Connecting device between a lower shell and a cuff of a ski boot, the ski boot comprising a lower shell, a cuff and a connecting device between the lower shell and the cuff, the connecting device comprising: a connecting ring configured to guide the cuff in rotation relative to the lower shell, a locking element that is movable between a first position and a second position, the locking element being able to prevent the connecting ring from rotating relative to the locking element when it is in its first position, a retaining element configured to retain the locking element in its first position.

16 Claims, 3 Drawing Sheets

CONNECTING DEVICE BETWEEN A LOWER SHELL AND A CUFF OF A SKI BOOT

This application claims priority to European Patent Application No. EP21425063.1 filed on Dec. 10, 2021, the contents of which is incorporated herein by reference in its entirety.

TECHNICAL FIELD OF THE INVENTION

The invention relates to a ski boot comprising a lower shell, a cuff and a connecting device between the lower shell and the cuff. The invention also relates to a method for adjusting the position of an axis of rotation between the lower shell and the cuff of such a ski boot.

PRIOR ART

Ski boots are essential accessories for skiing since they allow forces to be transmitted from the user thereof to one or more gliding boards. A ski boot traditionally comprises a lower shell and a cuff that is articulated in rotation about the lower shell. The lower shell envelops the user's foot and is intended to be secured to a ski. On the other hand, the cuff envelops the user's lower leg, around their tibia and their calf.

A ski boot has to be able to be put on and removed comfortably. It also has to allow the user thereof to flex their knees towards the front in order to ski. To this end, the ski boot comprises an articulation in rotation between the cuff and the lower shell, which permits a certain degree of flexion of the ankle when the ski boot is put on. This articulation has to be particularly solid and rigid so as to effectively transmit the forces of the skier to the gliding board in order to guide the latter.

The position of the axis of rotation between the lower shell and the cuff is crucial because it impacts the comfort of the ski boot. Specifically, this axis of rotation has to be able to be positioned as close as possible to the natural axis of flexion of the ankle in order to not bring about forces on the ankle or rubbing which could be painful when skiing. The lateral orientation of the cuff also has to conform to the natural inclination of the lower leg, which is bowed to a greater or lesser extent depending on the users.

Moreover, the position of the axis of rotation between the lower shell and the cuff also plays an important role in the overall performance of the ski boot. Specifically, the adjustment of the position of the axis of rotation between the lower shell and the cuff makes it possible to adjust the average inclination of the cuff with respect to the lower shell and/or makes it possible to optimize edging. The cuff can thus be inclined to a greater or lesser extent towards the front or on the sides depending on the level of experience of the user.

In order to allow the position of the axis of rotation between the lower shell and the cuff to be adjusted, ski boots comprising a connecting ring, also called canting ring, that connects the cuff to the lower shell are known from the publication EP3228202A1. The connecting ring comprises, for the one part, a blocking surface of square shape that cooperates with an opening in the lower shell so as to prevent the rotation of the connecting ring, and, for the other part, a rotation surface that cooperates with an opening in the cuff so as to guide the rotation of the cuff relative to the lower shell about this second surface. The rotation surface is eccentric with respect to the blocking surface. In order to adjust the position of the axis of rotation, the connecting ring is removed and pivoted by one, two or three quarter twists before being re-engaged in the opening in the lower shell. Such an adjustment device is insufficient because it only makes it possible to obtain a small number of different positions. Moreover, the adjustment operation is burdensome because it requires the removal of components which can easily be lost or incorrectly reassembled on the ski boot. During the removal of the adjustment device, the centring of the cuff on the lower shell may be lost, this rendering the reassembly operation more complex.

Presentation of the Invention

The aim of the invention is to provide a ski boot and a method for adjusting the axis of rotation of a ski boot that remedy the drawbacks above and improve the ski boots and adjustment methods known from the prior art.

More precisely, a primary subject of the invention is a ski boot, of which the position of the axis of rotation between the cuff and the lower shell is easier to adjust.

SUMMARY OF THE INVENTION

The invention relates to a ski boot comprising a lower shell, a cuff and a connecting device between the lower shell and the cuff, the connecting device comprising:

- a connecting ring comprising a first rotation surface configured to guide the cuff in rotation relative to the lower shell, the connecting ring comprising a second rotation surface that is eccentric with respect to the first rotation surface, the connecting ring comprising a first locking surface provided with reliefs,
- a locking element comprising a third rotation surface that cooperates with the second rotation surface so as to guide the connecting ring in rotation relative to the locking element, the locking element comprising a second locking surface provided with reliefs, the locking element being movable between a first position and a second position, the reliefs of the first locking surface cooperating with the reliefs of the second locking surface so as to prevent the connecting ring from rotating relative to the locking element when the locking element is in its first position, and so as to allow the connecting ring to rotate relative to the locking element when the locking element is in its second position,
- a retaining element configured to retain the locking element in its first position.

The first rotation surface may be configured to guide the cuff in rotation relative to the lower shell about a first axis of rotation, and the locking element may be movable in translation, parallel to said first axis of rotation, between its first position and its second position.

The locking element may comprise a blocking surface, notably a surface of square section, and the lower shell may comprise an opening with a shape that is complementary to the blocking surface, said blocking surface being engaged in said opening in the lower shell to prevent the locking element from rotating relative to the lower shell at least when the locking element is in its first position.

The first rotation surface may be configured to guide the cuff in rotation relative to the lower shell about a first axis of rotation, and the first locking surface and the second locking surface may extend substantially perpendicularly with respect to said first axis of rotation.

The reliefs of the first locking surface and of the second locking surface may be arranged with rotational symmetry.

The reliefs of the first locking surface and/or the reliefs of the second locking surface may comprise ramps that are inclined with respect to a plane perpendicular to said first axis of rotation.

The first rotation surface may be arranged on an outer periphery of the connecting ring, and the second rotation surface may be arranged on an inner periphery of the connecting ring.

The first rotation surface may be configured to guide the cuff in rotation relative to the lower shell about a first axis of rotation, and the connecting ring may comprise an abutment surface bearing against the cuff, the abutment surface being arranged so as to prevent the connecting ring from moving with respect to the cuff parallel to the first axis of rotation.

The locking element may comprise a through-opening that is concentric with the third rotation surface, and the retaining element may be a screw passing through the opening in the locking element, the screw cooperating with the lower shell or with a nut secured to the lower shell so as to retain the locking element in its first position.

The locking element may be secured to the ski boot when it is in its second position.

The retaining element may be secured to the ski boot when the locking element is in its second position, notably the retaining element may be a screw cooperating with a tapped opening secured to the lower shell, a length of the tapped opening being strictly greater than a dimension of the reliefs of the first locking surface and/or strictly greater than the dimension of the reliefs of the second locking surface.

The connecting ring may comprise at least one indentation that is able to cooperate with a tool to cause the connecting ring to pivot relative to the locking element when the locking element is in its second position.

The invention also relates to a kit comprising a ski boot as defined above and a tool configured to cooperate with the indentation to cause the connecting ring to pivot relative to the locking element when the locking element is in its second position.

The invention also relates to a method for adjusting the position of an axis of rotation between a lower shell and a cuff of a ski boot as defined above, the adjustment method comprising:

- the at least partial removal of the retaining element,
- the movement of the locking element from its first position to its second position,
- the rotation of the connecting ring relative to the locking element to reach a desired orientation,
- the movement of the locking element from its second position to its first position,
- the introduction of the retaining element.

The connecting ring may bear against the cuff during the rotation of the connecting ring relative to the locking element.

PRESENTATION OF THE FIGURES

These subjects, characteristics and advantages of the present invention will be set out in detail in the following description of a particular embodiment, given by way of non-limiting example with reference to the appended figures, in which.

DETAILED DESCRIPTION

Figure 1:
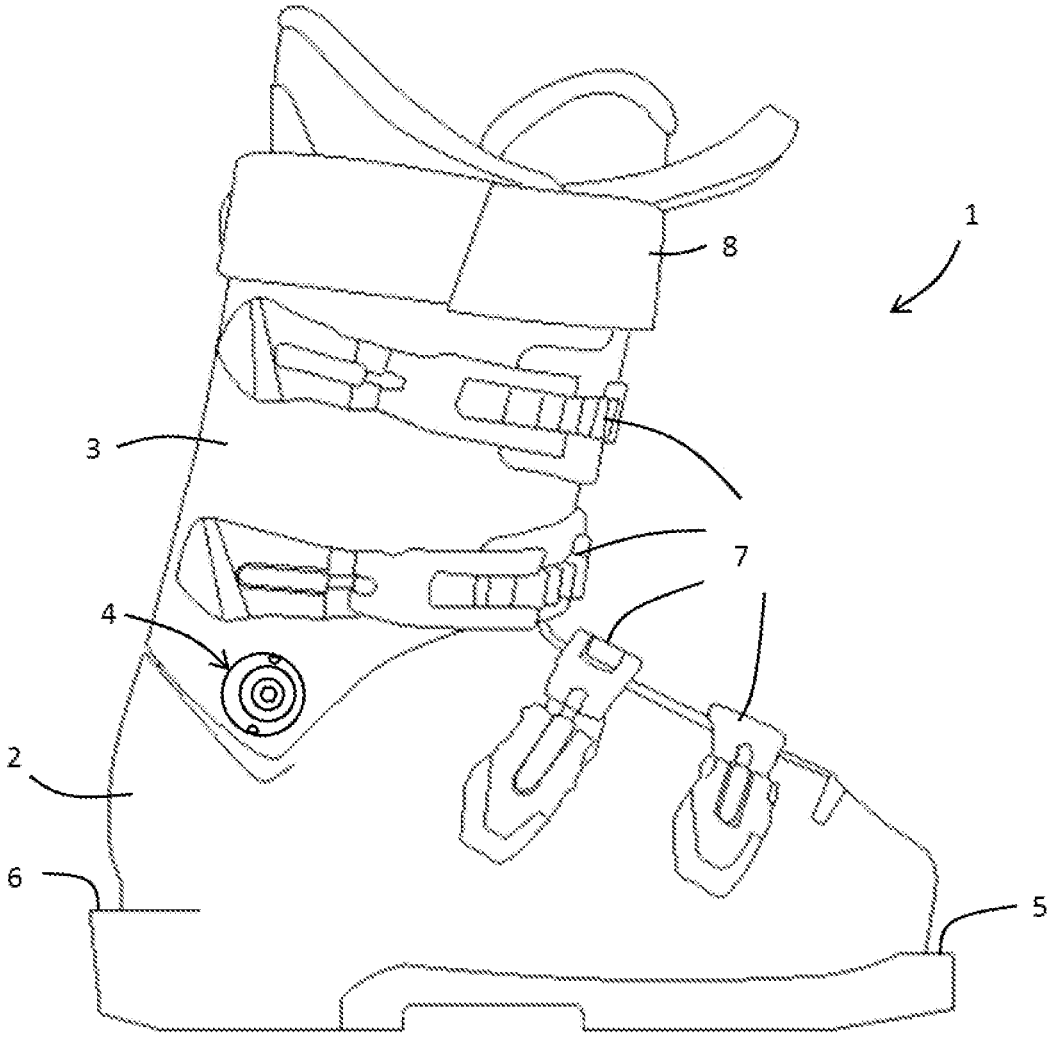
FIG. 1 is a schematic view of a ski boot according to one embodiment of the invention.
Figure 2:
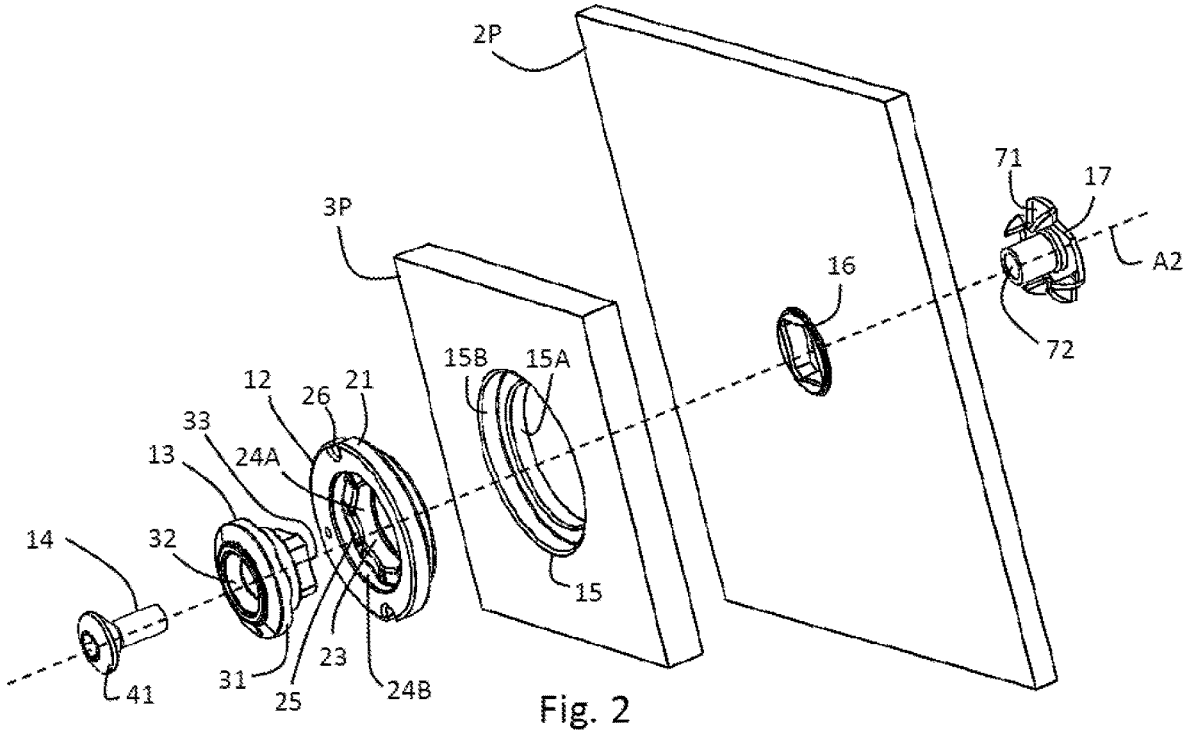
FIG. 2 is an exploded view, from outside the ski boot, of a connecting device of the ski boot.
Figure 3:
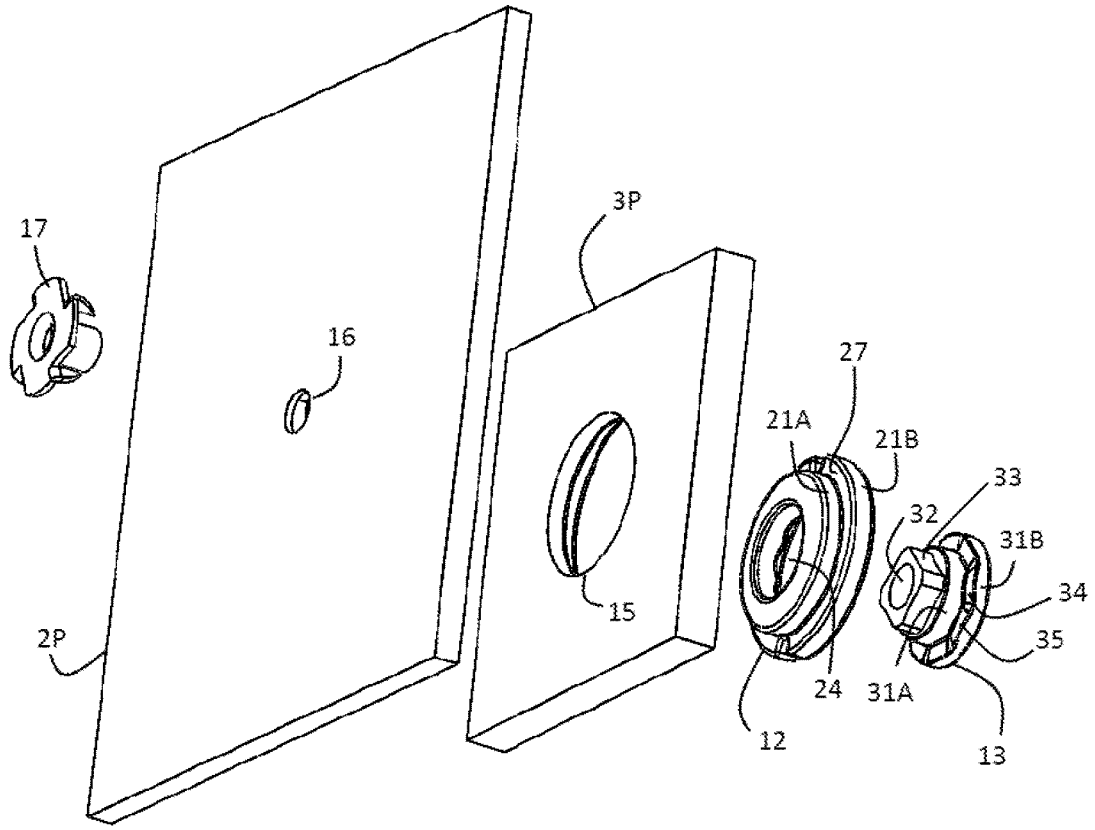
FIG. 3 is a partial exploded view, from inside the ski boot, of the connecting device.
Figure 4:
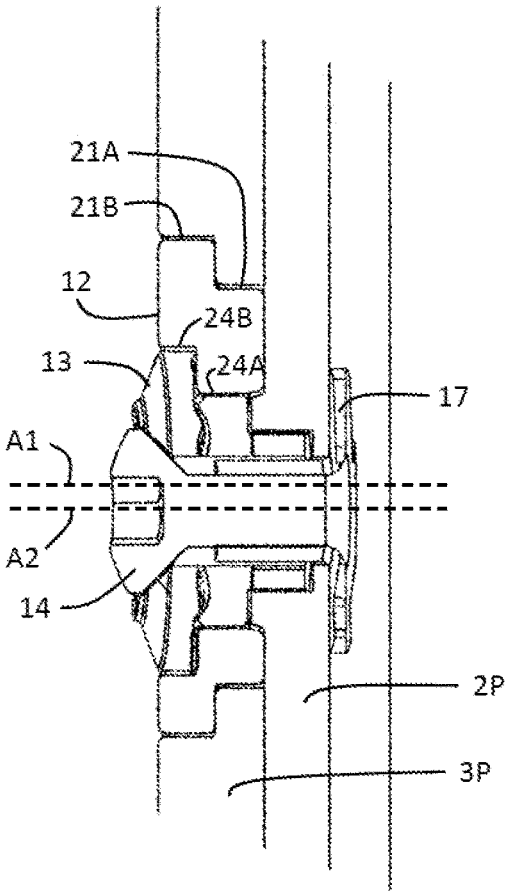
FIG. 4 is a first view in section of the connecting device, a locking element of the connecting device being in a first position.

FIG. 1 schematically illustrates a ski boot 1 according to one embodiment of the invention. The ski boot 1 is a downhill ski boot. As a variant, it could be a backcountry ski boot, a cross-country ski boot, and more generally any boot designed for the practice of a gliding sport on snow in which one or more gliding boards are guided by a user's feet. The ski boot is what is known as an ankle boot: it covers the foot and the lower leg above the ankles.

The ski boot 1 comprises a lower shell 2, a cuff 3 and at least one connecting device 4 between the lower shell and the cuff. The lower shell 2 covers the user's foot essentially as far as the user's ankles. It may notably comprise a front fastening interface 5 and a rear fastening interface 6, also called lugs of the ski boot, that are designed to cooperate with a fastening device which allows the ski boot to be secured to a gliding board. The cuff 3 covers the user's lower leg essentially from the ankles as far as around a third or half the height of the tibia. The lower shell 2 and the cuff 3 comprise tightening means such as buckles 7 or straps 8 which allow the ski boot to be tightened around the user's foot and lower leg. Lastly, the lower shell 2 and the cuff 3 have a rigidity designed for the transmission of forces from the user thereof to the gliding board to which the ski boot is attached. Notably, the lower shell 2 and the cuff 3 are preferably manufactured from plastics material, for example from polyurethane or equivalents. The lower shell 2 and the cuff 3 are two separate elements of the ski boot 1 which are articulated in rotation by way of the at least one connecting device 4. In particular, the cuff 3 is movable in rotation relative to the lower shell about a first transverse axis of rotation A1 which extends substantially parallel to the axis of flexion of the ankle. The ski boot therefore allows a certain degree of flexion of the ankle, and this allows the user thereof to walk wearing the ski boots but also to perform flexion and extension movements of the legs in order to ski.

The ski boot 1 preferably comprises two connecting devices 4 according to the invention, which are respectively positioned on an outer lateral side and on an inner lateral side of the boot. The outer lateral side denotes the right-hand side of a right boot and the left-hand side of a left boot. The inner lateral side denotes the left-hand side of a right boot and the right-hand side of a left boot. The two connecting devices 4 are positioned substantially at the height of the outer and inner malleoli of the user's foot. As a variant, the ski boot could comprise a single connecting device 4 according to the invention combined with a connecting device according to the prior art. The connecting device 4 according to the invention can then be arranged indifferently on the inner or outer lateral side of the ski boot. Each connecting device cooperates with a lateral wall 2P of the lower shell and with a lateral wall 3P of the cuff.

The connecting device 4 is shown in more detail in FIGS. 2 to 5.

The connecting device 4 primarily comprises a connecting ring 12, a locking element 13 and a retaining element 14. These three elements of the connecting device 4 are separate from one another and separate from the lower shell 2 and the cuff 3. They are arranged at a first opening 15 provided in a lateral wall 3P of the cuff 3 and at a second opening 16 provided in a lateral wall 2P of the lower shell 2. According to the embodiment shown, the retaining element 14 is a screw and the latter cooperates with a nut 17.

The cuff 3 covers the lower shell 2 at least at the openings 15 and 16, that is to say that the lateral wall 3P of the cuff in which the opening 15 is provided is positioned further towards the outside of the ski boot 1 than the lateral wall 2P of the lower shell in which the opening 16 is provided. The lateral wall 2P of the lower shell is therefore positioned further towards the inside of the ski boot, that is to say that it is closer to the user's foot than the lateral wall 3P of the cuff. The lateral walls 2P and 3P may be substantially planar, at least around the openings 15 and 16. As a variant, the positions of the lateral walls of the lower shell and of the cuff could be reversed. That is to say that the element in which the opening 15 is formed could be a wall of the lower shell, and the element in which the opening 16 is formed could be a wall of the cuff.

The connecting ring 12 comprises a first rotation surface 21 configured to guide the cuff 3 in rotation relative to the lower shell 2. To this end, the first rotation surface 21 cooperates with the opening 15 which is of circular shape. The first rotation surface 21 may notably comprise a surface exhibiting symmetry of revolution, notably a cylindrical or frustoconical surface. It is arranged on the outer periphery of the connecting ring 12. The connection between the connecting ring 12 and the cuff is therefore a pivot connection, and this connection defines the first axis of rotation A1 of the cuff 3 relative to the lower shell 2.

The connecting ring 12 may be positioned in the thickness of the lateral wall of the cuff. The dimension of the connecting ring along the first axis of rotation A1 may be substantially equal to the thickness of the lateral wall 3P of the cuff, for example of the order of 1 mm to 20 mm.

Advantageously, the connecting ring 12 also comprises an abutment surface 27 bearing against the lateral wall of the cuff. This abutment surface is arranged so as to prevent the connecting ring from moving with respect to the cuff parallel to the first axis of rotation A1. This makes it possible to maintain the positioning of the first rotation surface 21 in the opening 15, even when forces parallel to the first axis of rotation A1 and oriented towards the interior of the ski boot are applied to the connecting ring. More precisely, the opening 15 comprises a counterbore, that is to say that it comprises two separate sections 15A, 15B of different diameter. A first section 15A extends substantially from half the thickness of the lateral wall 3P of the cuff as far as the inner surface of the lateral wall of the cuff. A second section 15B extends substantially from half the thickness of the lateral wall of the cuff as far as the outer surface of the lateral wall of the cuff. The first section 15A comprises a diameter strictly smaller than the diameter of the second section 15B. The connecting ring 12 has an outer shape that is substantially complementary to the shape of the opening 15. It therefore comprises a first surface 21A and a second surface 21B that cooperate with the sections 15A and 15B, respectively. The connecting ring 12 thus comprises a shoulder forming a stop bearing against the counterbore formed in the lateral wall of the cuff. The diameter of the first surface 21A and of the second surface 21B may be slightly smaller, respectively, than the diameters of the first section 15A and of the second section 15B so as to allow the cuff to rotate freely about the first rotation surface, without friction. The two surfaces 21A and 21B together may constitute the first rotation surface 21, or the first rotation surface 21 may comprise only one or other of the two surfaces 21A and 21B.

The connecting ring 12 further comprises a second rotation surface 23 that is eccentric with respect to the first rotation surface 21. The second rotation surface 23 may notably be a surface exhibiting symmetry of revolution, notably a cylindrical or frustoconical surface. It is arranged on the inner periphery of the connecting ring 12, that is to say that the connecting ring comprises a circular opening 24 delimited by the second rotation surface 23.

The locking element 13 is at least partially positioned inside the opening 24. It comprises a third rotation surface 31 that cooperates with the second rotation surface 23 so as to guide the connecting ring 12 in rotation relative to the locking element 13. As above, the third rotation surface may notably be a surface exhibiting symmetry of revolution, notably a cylindrical or frustoconical surface. It is arranged on an outer periphery of the locking element 13.

The connecting ring 12 is therefore movable in rotation relative to the locking element about a second axis of rotation A2, parallel to the first axis of rotation A1. Since the second rotation surface 23 is eccentric with respect to the first rotation surface 21, there is a non-zero distance between the first axis of rotation A1 and the second axis of rotation A2. This distance may, for example, be between 1 mm and 10 mm. As will be seen below, the rotation of the connecting ring 12 with respect to the locking element 13 is possible only when the locking element is in a certain position, during a method for adjusting the position of the first axis of rotation A1 of the ski boot. The distance between the axes of rotation A1 and A2 is determined as a function of the desired adjustment amplitude.

The opening 24 comprises a counterbore, that is to say that it comprises two separate sections 24A, 24B of different diameter. A first section 24A extends substantially from half the thickness of the connecting ring 12 as far as an inner surface of the connecting ring 12, and a second section 24B extends substantially from half the thickness of the connecting ring 12 as far as an outer surface of the connecting ring 12. The first section 24A comprises a diameter strictly smaller than the diameter of the second section 24B.

The locking element 13 has an outer shape that is substantially complementary to the shape of the opening 24. It therefore comprises a first surface 31A and a second surface 31B that cooperate with the sections 24A and 24B, respectively. The diameters of the first surface 31A and of the second surface 31B may be slightly smaller, respectively, than the diameters of the first section 24A and of the second section 24B so as to allow the connecting ring 12 to rotate freely relative to the locking element 13, without friction. The two sections 24A and 24B together may constitute the second rotation surface 23, or the second rotation surface 23 may comprise only one or other of the two sections 24A and 24B.

It is noted that the first rotation surface 21, the second rotation surface 23 and the third rotation surface 31 may be formed by a set of portions exhibiting symmetry of revolution, which are interrupted by portions which are not necessarily portions exhibiting symmetry of revolution. Specifically, guidance in rotation by two rotation surfaces does not require these surfaces to be portions exhibiting symmetry of revolution that is uninterrupted over a full turn. Thus, the first rotation surface 21 is interrupted by two diametrically opposed indentations 26 that are able to cooperate with a tool to cause the connecting ring to pivot relative to the locking element about the second axis of rotation A2.

Figure 5:
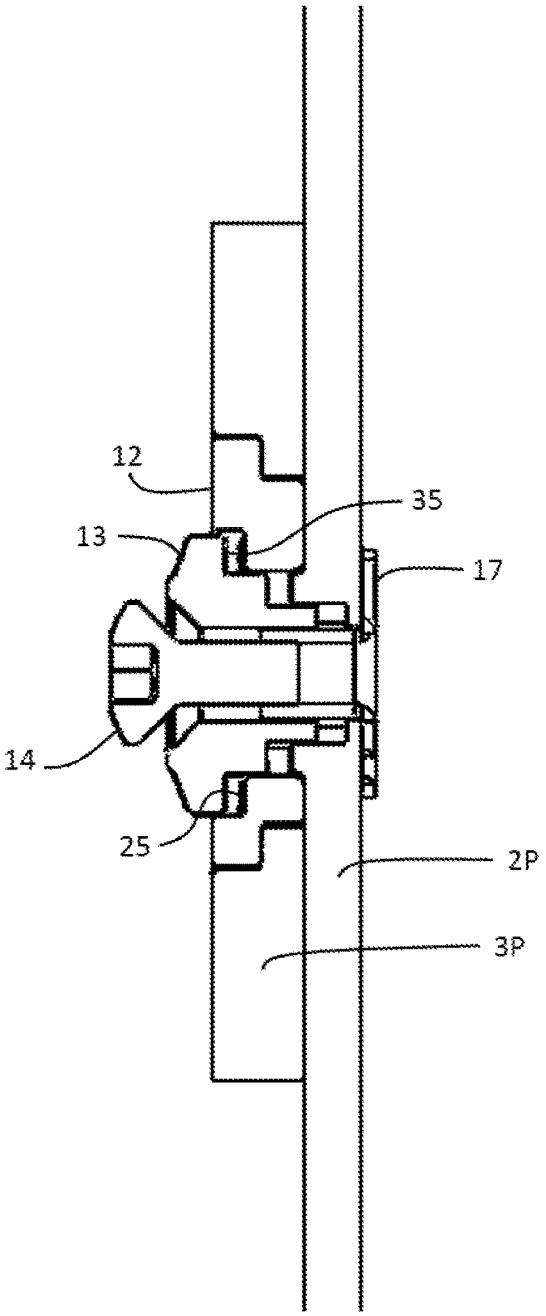
FIG. 5 is a second view in section of the connecting device, the locking element being in a second position.

The locking element 13 is movable relative to the connecting ring 12 between a first position (illustrated in FIG. 4) and a second position (illustrated in FIG. 5). In particular, the locking element is movable between its two positions by translation parallel to the first axis of rotation A1 (or in other words parallel to the second axis of rotation A2 since these two axes are parallel). The movability of the locking element 13 is possible only when the retaining element 14 (in this instance a screw) does not retain the locking element in its first position. Since the cuff 3, the lower shell 2 and the connecting ring 12 are secured in translation parallel to the axis of rotation A1 or A2, the locking element 13 is also movable relative to the cuff and to the lower shell between its first position and its second position. It is noted that the locking element 13 remains secured to the ski boot, and notably to other elements of the connecting device, when it is in its first position and when it is in its second position.

The connecting ring 12 comprises a first locking surface 25, and the locking element 13 comprises a second locking surface 35. These two locking surfaces 25, 35 are each provided with reliefs that cooperate with one another so as to prevent the connecting ring from rotating relative to the locking element when the locking element is in its first position. By contrast, when the locking element is in its second position, the reliefs of each of the locking surfaces no longer cooperate with one another so as to allow the connecting ring to rotate relative to the locking element.

The first locking surface 25 is arranged at the counterbore, between the two sections 24A and 24B. The second locking surface 35 is arranged at the shoulder, between the two surfaces 31A and 31B. The two locking surfaces extend over disc surfaces, substantially perpendicularly with respect to the axis of rotation A1 or A2. According to an embodiment variant (not shown), the first locking surface could be formed on the first section 24A, and the second locking surface could be formed on the first surface 31A. In this case, the second rotation surface and the third rotation surface could then be respectively formed on the second section 24B and on the second surface 31B. Conversely, the first locking surface could be formed on the second section 24B, and the second locking surface could be formed on the second surface 31B, the second rotation surface and the third rotation surface then respectively being formed on the first section 24A and on the first surface 31A. According to these embodiment variants, the reliefs would therefore be arranged radially and not axially as is the case in the embodiment illustrated.

The retaining element 14 is configured to retain the locking element 13 in its first position. Thus, the connecting ring 12 is retained against the cuff 3 by way of the locking element 13. In this case, the retaining element 14 is a screw passing through an opening 32 in the locking element 13. The opening 32 is a through-opening that is concentric with the third rotation surface, that is to say an opening the central axis of which corresponds to the second axis of rotation A2. The screw cooperates with the nut 17 so as to retain the locking element 13 pressed against the connecting ring 12. The nut 17 is arranged on the side of an inner face of the lateral wall 2P of the lower shell. In particular, the nut 17 may be a claw nut. The nut 17 therefore comprises claws 71 which project parallel to the axis of rotation A1 or A2 and which are planted into the lateral wall 2P of the lower shell. Thus, the nut 17 can remain fastened to the lower shell, even when the screw is not engaged with the nut. The nut 17 comprises a tapped opening 72, that is to say a threaded opening, arranged in a cylindrical portion which extends in the thickness of the lateral wall 2P of the lower shell, at the height of the opening 16. According to one embodiment variant, the tapped opening 72 with which the screw cooperates could be formed directly in the lateral wall 2P of the lower shell. The screw comprises a screw head 41 which can be positioned in a seat with a shape that is complementary to the screw head and which is formed in the opening 32. Thus, the screw head does not go beyond, or goes slightly beyond, the lateral side of the ski boot. Notably, the screw head and the seat with which it cooperates have a conical shape. As a variant, the locking element could be embodied differently, for example in the form of a pin or an attachment of the quarter-turn type. In general, the retaining element is also movable between a first position and a second position. The retaining element can remain secured to the ski boot when the locking element is in its second position. Advantageously, the length of the tapped opening 72 along the axis A2 is strictly greater than the dimension of the reliefs of the first locking surface 25 and/or strictly greater than the dimension of the reliefs of the second locking surface 35 along the axis A2. Thus, the screw can be unscrewed to a sufficient extent to disengage the reliefs from one another, while remaining secured to the tapped opening 72 of the nut 17 or the shell. The retaining element could be, for example, a captive screw.

The reliefs of the first locking surface and of the second locking surface may be complementary reliefs, that is to say that they have shapes allowing their mutual engagement. They may be arranged with rotational symmetry. In other words, the reliefs comprise a pattern repeated according to a given interval. The number of intervals then defines the number of possible positions of the connecting ring 12 relative to the locking element 13 when the locking element is in its first position. The reliefs may be, for example, U-shaped or V-shaped slots, ridges, teeth or sinusoidal waves that are arranged regularly on each of the locking surfaces. The number of separate positions of the connecting ring relative to the locking element may be, for example, between four and 20, or for example between four and 12. According to another embodiment, the reliefs could take the form of rough surfaces, and this would make it possible to envisage a greater number of separate positions of the connecting ring relative to the locking element, or even an infinite number of relative positions. In general, the reliefs will be determined in such a way as to guarantee an absence of relative rotation between the connecting ring and the locking element when the locking element is in its first position.

The distance separating the first position of the locking element from its second position is at least equal to the size of the reliefs along the axis of rotation A1 or A2, so as to allow the mutual disengagement of the reliefs when the locking element is in its second position. This distance may be, for example, between 1 mm and 10 mm approximately.

Advantageously, the reliefs comprise ramps 34 that are inclined with respect to a plane perpendicular to the axis of rotation A1 or A2. These ramps 34 make it possible to induce a movement of the locking element parallel to the axis of rotation A1 or A2 when the connecting ring is pivoted relative to the locking element. Thus, it is not necessary to pull on the locking element to cause it to pass from its first position to its second position. This movement occurs automatically when the connecting ring is pivoted relative to the locking element about the second axis of rotation A2.

Furthermore, the locking element 13 comprises a blocking surface 33, notably a surface of square section. The opening 16 in the lower shell has a shape that is complementary to the blocking surface 33. The opening 16 therefore also has a square shape. The blocking surface 33 is engaged in the opening 16 in such a way as to prevent the locking element from rotating relative to the lower shell. The blocking surface 33 is engaged in the opening 16 at least when the locking element is in its first position. Thus, there is no risk of the connecting ring pivoting with respect to the lower shell when the locking element is in its first position. The adjustment of the position of the axis of rotation A1 can thus be maintained throughout the use of the ski boot. This blocking surface 33 may also remain engaged in the opening 16 when the locking element reaches its second position. The cooperation between the blocking surface 33 and the opening 16 then forms a guide in translation of the locking element 13. The locking element is then movable between its first position and its second position along a sliding connection. This has the advantage of maintaining the centring between the locking element and the lower shell during the operation for adjusting the position of the first axis of rotation A1. It is therefore easier to push the locking element back into its first position. As a variant from a square shape, the blocking surface 33 and the opening 16 could have any other profiled shape that prevents these elements from rotating relative to one another: for example a triangular shape, a star shape, or even any polygonal shape.

The connecting ring 12, the locking element 13, the retaining element 14, and the nut 17 are preferably made of metal so as to support significant forces transmitted by the user of the boot. The opening 16 may comprise a metallic insert with a shape that is complementary to the blocking surface 33. Thus, the rotation prevention obtained by the cooperation between the blocking surface 33 and the opening 16 results from a metal-metal contact, thus allowing a more durable rotation prevention.

The invention also relates to a kit comprising the ski boot 1 and a tool configured to cooperate with the indentation 26 of the connecting ring 12, to cause the connecting ring to pivot relative to the locking element when the locking element is in its second position. The tool may, for example, comprise a metallic plate equipped with two points, the spacing of which is adapted to cooperate with the two indentations 26. Advantageously, this same tool may also comprise means for tightening or untightening the screw constituting the retaining element 14.

In order to adjust the position of the first axis of rotation A1, it is possible to proceed in the following manner. First of all, the retaining element 14 is at least partially removed. Notably, the fastening screw is unscrewed. Advantageously, the retaining element is not completely uncoupled from the connecting device. Notably, the screw is not completely unscrewed but remains in engagement with the tapped opening 72 of the nut 17. The screw head 41 then no longer bears against the locking element and the latter can be moved freely in translation parallel to the axis of rotation A1 or A2 from its first position to its second position. The locking element remains secured to the ski boot even when it is in its second position.

Then, the connecting ring 12 is pivoted, notably by means of the adjustment tool, the shape of which allows it to cooperate with the two indentations 26. As seen above, the rotation of the connecting ring 12 makes it possible to transmit, via the ramps 27, a force which causes the locking element to pass from its first position to its second position. The connecting ring is thus pivoted until the first axis of rotation reaches the selected position. A rotation of the connecting ring 12 relative to the locking element 13 occurs only during the operation for adjusting the position of the first axis of rotation A1.

During the pivoting of the connecting ring, a movement of the cuff relative to the lower shell occurs since the first axis of rotation A1, on which the cuff is centred, is shifted with respect to the second axis of rotation A2 about which the connecting ring pivots. The force required to move the cuff during the adjustment is transmitted perfectly from the connecting ring to the cuff by the first rotation surface 21. Specifically, the connecting ring 12 continues to bear against the cuff during the rotation of the connecting ring relative to the locking element. Thus, there is no risk of losing the centring between the connecting ring and the cuff during this adjustment operation. Advantageously, when the user manipulates the tool to cause the connecting ring to pivot, they at the same time exert a force oriented parallel to the axis of rotation A1 or A2 and oriented from the outside towards the inside of the ski boot. This force makes it possible to keep the abutment surface 27 bearing against the lateral wall of the cuff.

It is noted that, assuming the ski boot comprises two connecting devices 4 on either side of the ski boot, it is not necessary for the respective first axes of rotation of the two connecting devices 4 to be aligned. Specifically, the lower shell 2 and the cuff 3, although rigid enough to transmit the forces of the user, nevertheless comprise a certain degree of elasticity that makes it possible to compensate for a misalignment between these two axes. This misalignment may also be compensated by the small clearances between the different rotation surfaces. However, these potential misalignments may give rise to forces in the cuff which then tends to adopt an equilibrium position. It will therefore be appreciated that the movement of the axis of rotation A1, although a movement of only a few millimetres, involves displacing the cuff from its equilibrium position and therefore requires a certain amount of force. The bearing of the first rotation surface 21 on the opening 15 of the cuff allows this force to be transmitted in an ideal manner.

Once the first axis of rotation has reached the desired position, the locking element can be moved from its second position to its first position. This operation may give rise to a slight pivoting of the connecting ring 12 such that the respective reliefs of the two locking surfaces are positioned facing one another. A multitude of separate positions of the first axis of rotation are possible as a function of the interval between the reliefs that are arranged on the two locking surfaces.

Lastly, the retaining element can be reintroduced so as to avoid any subsequent movement of the locking element. Notably, the screw can be screwed into the tapped opening 72. Advantageously, this screw can be screwed relatively tightly without clamping the lateral wall of the cuff against the lateral wall of the lower shell. It is therefore possible to reduce the risk of the screw subsequently unscrewing itself by screwing it tightly, without negatively affecting the fluidity of the articulation in rotation between the lower shell and the cuff.

Then, when the user practices a gliding sport with the ski boots 1, they perform flexion and extension movements of the legs. These movements lead to pivoting of the cuff 2 with respect to the lower shell about the first axis of rotation A1. A sliding action is established between the cuff and the connecting ring at the first rotation surface. The connecting ring 12, the locking element 13, and the retaining element are fixed relative to the lower shell. The orientation of the connecting ring 12 is not modified during the practicing of the gliding sport.

The invention claimed is:

1. A ski boot comprising a lower shell, a cuff and a connecting device between the lower shell and the cuff, wherein the connecting device comprises:

a connecting ring comprising a first rotation surface configured to guide the cuff in rotation relative to the lower shell, the connecting ring comprising a second rotation surface that is eccentric with respect to the first rotation surface, the connecting ring comprising a first locking surface provided with reliefs, a locking element comprising a third rotation surface that cooperates with the second rotation surface so as to guide the connecting ring in rotation relative to the locking element, the locking element comprising a second locking surface provided with reliefs, the locking element being movable between a first position and a second position, the reliefs of the first locking surface cooperating with the reliefs of the second locking surface so as to prevent the connecting ring from rotating relative to the locking element when the locking element is in the first position, and so as to allow the connecting ring to rotate relative to the locking element when the locking element is in the second position, a retaining element configured to retain the locking element in the first position.

2. The ski boot according to claim 1, wherein the first rotation surface is configured to guide the cuff in rotation relative to the lower shell about a first axis of rotation, and wherein the locking element is movable in translation, parallel to said first axis of rotation, between the first position and the second position.

3. The ski boot according to claim 2, wherein the reliefs of the first locking surface and/or the reliefs of the second locking surface comprise ramps that are inclined with respect to a plane perpendicular to said first axis of rotation.

4. The ski boot according to claim 1, wherein the locking element comprises a blocking surface and wherein the lower shell comprises an opening with a shape that is complementary to the blocking surface, said blocking surface being engaged in said opening in the lower shell to prevent the locking element from rotating relative to the lower shell at least when the locking element is in the first position.

5. The ski boot according to claim 4, wherein the blocking surface is a surface of square section.

6. The ski boot according to claim 1, wherein the first rotation surface is configured to guide the cuff in rotation relative to the lower shell about a first axis of rotation, and wherein the first locking surface and the second locking surface extend perpendicularly with respect to said first axis of rotation.

7. The ski boot according to claim 1, wherein the reliefs of the first locking surface and of the second locking surface are arranged with rotational symmetry.

8. The ski boot according to claim 1, wherein the first rotation surface is arranged on an outer periphery of the connecting ring, and wherein the second rotation surface is arranged on an inner periphery of the connecting ring.

9. The ski boot according to claim 1, wherein the first rotation surface is configured to guide the cuff in rotation relative to the lower shell about a first axis of rotation, and wherein the connecting ring comprises an abutment surface bearing against the cuff, the abutment surface being arranged so as to prevent the connecting ring from moving with respect to the cuff parallel to the first axis of rotation.

10. The ski boot according to claim 1, wherein the locking element comprises a through-opening that is concentric with the third rotation surface, and wherein the retaining element is a screw passing through the opening in the locking element, the screw cooperating with the lower shell or with a nut secured to the lower shell so as to retain the locking element in the first position.

11. The ski boot according to claim 1, wherein the locking element is secured to the ski boot when it is in the second position.

12. The ski boot according to claim 1, wherein the retaining element is secured to the ski boot when the locking element is in the second position, and wherein the retaining element comprises a screw cooperating with a tapped opening secured to the lower shell, a length of the tapped opening being greater than a dimension of the reliefs of the first locking surface and/or greater than the dimension of the reliefs of the second locking surface.

13. The ski boot according to claim 1, wherein the connecting ring comprises at least one indentation that is able to cooperate with a tool to cause the connecting ring to pivot relative to the locking element when the locking element is in the second position.

14. A kit comprising a ski boot according to claim 13, and a tool configured to cooperate with the indentation to cause the connecting ring to pivot relative to the locking element when the locking element is in the second position.

15. A method for adjusting the position of an axis of rotation between the lower shell and the cuff of the ski boot according to claim 1, the method comprising:

removing, at least partially, the retaining element, moving the locking element from the first position to the second position, rotating the connecting ring relative to the locking element to reach a desired orientation, moving the locking element from the second position to the first position, introducing the retaining element.

16. The method according to claim 15, wherein the connecting ring bears against the cuff during the rotation of the connecting ring relative to the locking element.

* * * * *